US008672136B2

(12) United States Patent
D'Amico

(10) Patent No.: US 8,672,136 B2
(45) Date of Patent: Mar. 18, 2014

(54) TRAY SYSTEM

(76) Inventor: Roberto D'Amico, Bree (BE)

( * ) Notice: Subject to any disclaimer, the term of this patent is extended or adjusted under 35 U.S.C. 154(b) by 0 days.

(21) Appl. No.: 13/637,562

(22) PCT Filed: Mar. 30, 2011

(86) PCT No.: PCT/EP2011/054908

§ 371 (c)(1),
(2), (4) Date: Nov. 14, 2012

(87) PCT Pub. No.: WO2011/121021

PCT Pub. Date: Oct. 6, 2011

(65) Prior Publication Data

US 2013/0105353 A1 May 2, 2013

(30) Foreign Application Priority Data

Mar. 30, 2010 (EP) ..... 10158470

(51) Int. Cl.
*B65D 1/34* (2006.01)

(52) U.S. Cl.
USPC ..... 206/559; 206/818

(58) Field of Classification Search
USPC ..... 206/557, 558, 559, 560, 565, 818; 220/23.83, 23.87, 23.88, 23.89, 759
See application file for complete search history.

(56) References Cited

U.S. PATENT DOCUMENTS 2,180,540 A * 11/1939 Moebus et al. ..... 294/143
2,652,087 A 9/1953 Turpin
2,741,901 A * 4/1956 Silos ..... 211/85.4
2,845,207 A * 7/1958 Klinghoffer ..... 220/23.83
3,123,935 A * 3/1964 Williams ..... 248/346.01
3,228,536 A * 1/1966 Gratzer ..... 414/9
3,446,416 A * 5/1969 Epstein ..... 206/557
3,610,459 A * 10/1971 Hanson ..... 220/23.83
3,815,175 A * 6/1974 Szabados ..... 220/759
4,573,579 A * 3/1986 Murdick et al. ..... 206/525
5,505,330 A * 4/1996 Nunes ..... 220/742
5,718,158 A * 2/1998 Rogge ..... 83/762
5,927,701 A * 7/1999 Chapman ..... 269/87.2
6,102,246 A * 8/2000 Goulet et al. ..... 221/11
6,112,899 A * 9/2000 Zeringue ..... 206/541
6,179,377 B1 * 1/2001 Harper ..... 297/148

(Continued)

FOREIGN PATENT DOCUMENTS

DE 2358448 A1 5/1975
DE 29600865 U1 5/1997

(Continued)

OTHER PUBLICATIONS

Extended European Search Report for European Application No. 10158470.4 issued on Jan. 18, 2011.

*Primary Examiner* — Jacob K Ackun
(74) *Attorney, Agent, or Firm* — Bozicevic, Field & Francis LLP; Bret E. Field

(57) ABSTRACT

A tray system is disclosed, comprising a tray for carrying food articles which is magnetized in at least one magnetized area of the tray, and comprising at least one holder adapted for holding a filled food article, the tray and the at least one bread holder being adapted such that when the bread holder is placed on the at least one magnetized area of the tray, the bread holder is attracted to the tray, the magnetic attraction force between the bread holder and the tray being large enough in order to prevent the holder from falling over when filled.

18 Claims, 6 Drawing Sheets

(56) References Cited

U.S. PATENT DOCUMENTS

| | | | | |
|---|---|---|---|---|
| 6,257,439 | B1 * | 7/2001 | Hsu | 220/759 |
| 6,389,944 | B1 * | 5/2002 | Davidson | 83/762 |
| 6,755,318 | B2 * | 6/2004 | Burke et al. | 220/703 |
| 7,228,982 | B2 * | 6/2007 | Nielson | 215/396 |
| 7,975,623 | B1 * | 7/2011 | Gassick et al. | 108/43 |
| 2004/0159620 | A1 | 8/2004 | Ross | |
| 2007/0235399 | A1 * | 10/2007 | Kim | 211/85.4 |

FOREIGN PATENT DOCUMENTS

| | | | |
|---|---|---|---|
| DE | 10334949 | A1 | 3/2005 |
| EP | 1595478 | A2 | 11/2005 |
| FR | 991845 | A | 10/1951 |
| GB | 853161 | A | 11/1960 |

* cited by examiner

TRAY SYSTEM

TECHNICAL FIELD OF THE INVENTION

The present invention relates to the field of food manipulation means in the catering and hotel industry and in snack bar industry. More specifically it relates to manipulation means for small bread as for instance pita bread, döner kebab bread, shawarma bread and similar types of bread.

BACKGROUND OF THE INVENTION

Snack bars which are serving small breads are very common and can be found almost anywhere these days. The small breads come in a great variety, as for instance as pita bread, shawarma bread or döner kebab bread. The same types of bread carry also different names in different places of the world.

In snack bars or in the catering industry in general, but also in the hamburger industry, the use of serving trays is very common in order to give the consumer or personnel more flexibility and in order to increase efficiency and comfort. Moreover serving trays can offer additional income as they can comprise advertisements and publicity.

The problem with many snacks is that they comprise bread, typically cut half-way, which is filled with food as for instance fine cut meat and vegetables and often sauces. When these types of bread are put on the tray when served, or later while the consumer is eating the bread, the content of the bread often drops out of the bread, resulting in a loss of food, more waste, and the necessity of cleaning the tray and/or table. This effect got even more pronounced because many customers send email, SMS etc. or are involved in phone calls today, increasing the amount of distractions for which the bread has to be put on the tray.

SUMMARY OF THE INVENTION

It is an object of the present invention to provide a tray system which solves at least one of the above problems.

This is achieved by the characterizing features of claim 1.

According to a first aspect of the present invention a tray system is disclosed comprising a tray for carrying food articles which is magnetized in at least one magnetized area of the tray, and comprising at least one holder adapted for holding a filled food article, the tray and the at least one holder being adapted such that when the holder is placed on the at least one magnetized area of the tray, the holder is attracted to the tray, the magnetic attraction force between the holder and the tray being large enough in order to prevent the holder from falling over when filled.

According to preferred embodiments at least the base of the holder comprises material that can be attracted by a magnetic force. Preferably also the sidewalls of the holder comprise a material that can be attracted by a magnet.

The tray can for instance be a serving tray, a dinner tray or an eating tray.

The filled food article is preferably, halfway-cut bread type, which is preferably adapted for being able to retain food filling within the bread, as it is typically closed at one side. The food filling can for instance comprise, meat, vegetables and/or sauce. The holder may also be adapted for other types of filled food articles as for instance ice cream cones, etc.

The holder is preferably adapted for holding filled food articles of predetermined sizes, for instance corresponding to the size of a pita bread, döner kebab bread, shawarma bread, sandwich bread, etc.

In embodiments according to the first aspect of the present invention the holder is provided with at least one pair of slots which are adapted for receiving and guiding a knife such that the knife can cut a bread held in the holder.

In embodiments according to the first aspect of the present invention the holder comprises a substantially U-shaped folded sheet of metal. It may comprise stainless steel, preferably with magnetic properties, all ferro and non-ferro materials, plastic, wood, etc.

The holder can be formed by folding a pre-cut metal sheet the metal sheet being pre-cut according to a predetermined pattern, the pattern defining the outline of the holder and possibly also coupling structures, slots, or other features of the holder.

In embodiments according to the first aspect of the present invention the holder further comprises at least one holder coupling means, and the system further comprising a holder manipulation means adapted for being coupled with the holder coupling means, the strength of the coupling being strong enough such that the holder can be carried by means of the holder manipulation means.

According to preferred embodiments the strength of the coupling is strong enough such that the holder can be carried by means of the holder manipulation means when the holder is holding a filled food article, e.g. a filled bread. Preferably, the holder manipulation means can be detachably coupled with the holder coupling means.

According to preferred embodiments, the holder comprises more than one, for instance two, coupling means, positioned for instance on opposite sides of the holder.

According to preferred embodiments, at least one slot as described above, runs through at least one holder coupling means. Each of two cooperating slots can run though one of the respective holder coupling means.

According to preferred embodiments the holder coupling means are positioned within the upper half of the height of the holder, preferably above ⅔ of the height of the holder, for instance at about ⅔ or ¾ or ⅘ of the height of the holder. This can improve comfort when handling the holders. According to preferred embodiments of the present invention, the holders are adapted for being stacked on top of each other by inserting the basis of a previous holder in the opening of a next holder. The holder coupling means may be the limiting factor or blocking element determining how far a first holder can be inserted into a second, similar holder. The more the holder coupling means is then positioned towards the upper rim of the holder, the better identical holders can be stacked on top of each other and the less storage volume is necessary for a predetermined number of identical holders.

In embodiments according to the first aspect of the present invention, the strength of the coupling between the holder coupling means and the manipulation means is such that it allows removing the holder comprising the bread from the at least one magnetized area of the tray. Removing the holder from the magnetic area of the tray, as described above, may include first tilting the holder on one side, thereby using the remaining contact surface between the holder and the magnetic area as a rotation axis, and consequently gradually reducing the magnetic attraction force between the holder and the tray, and afterwards lifting the holder completely from the tray surface.

According to preferred embodiments the strength of the coupling between the holder coupling means and the holder manipulation means is such that it allows removing the holder comprising the filled food article from at least one magnetized area of the tray in a direction substantially inclined with respect to the main surface of the tray. The direction may be substantially perpendicular on the main surface of the tray.

According to preferred embodiments the holder coupling means is of the hook-type, the opening of the hook being directed downwards during use, and wherein the holder manipulation means is adapted for coupling with the hook by cooperating with the opening.

According to preferred embodiments the holder manipulation means comprises a coupling structure of the ring type for coupling with the holder coupling means of the hook-type. Preferably, when the hook and the ring are coupled with each other, the holder manipulation means and the holder are fixed with respect to each other when the holder manipulation means is moved in an upward direction with respect to the holder (upward direction is away from the base within the holder).

According to preferred embodiments the holder coupling means can be created out of a U/V shaped cut in the sidewalls of the holder. The holder coupling means can comprise at least one outwardly bent flap of the sidewall of the holder, the flap being formed by a cut in said sidewall. The cut can be advantageously being substantially U or V shaped.

According to preferred embodiments of the present invention the holder coupling means comprises a part of the sidewall of the holder, the part comprising a material which can couple magnetically with a magnet, and the holder manipulation means comprises a coupling means comprising at least one magnet for coupling with the part.

According to preferred embodiments of the present invention the holder coupling means further comprises a blocking means for preventing the holder manipulation means from sliding upwardly on the sidewall of the holder when coupled.

According to preferred embodiments of the present invention the blocking means is formed by an inverted-T-shaped cut, the flaps defined by the cut being bent outwardly.

According to preferred embodiments of the present invention the holder manipulation means is adapted for being able to provide a leverage effect when decoupling the at least one magnet from the holder.

According to preferred embodiments, the coupling means of the holder manipulation means comprises an upwardly extending protrusion which is adapted for fitting behind the outwardly bent flaps of the blocking means, when said holder manipulation means is coupled with said holder.

The upwardly extending protrusion can advantageously comprise a curved surface which corresponds to the back surfaces (inner surfaces) of the outwardly bent flaps of the blocking means when coupled with the holder coupling means. In other words the curved surface is advantageously adapted for fitting against, or resting against the back surfaces of the flaps.

This leverage effect can be caused by pressing on the flags when performing an upward pivoting movement of the manipulation means thereby pulling away the at least one magnet from the holder.

According to preferred embodiments, the inverted-T-shaped cut defining the blocking means, or at least part of the coupling means of the holder is such that the lower surface of the flaps are laying mainly within a single plane, when they have been bent outwards. This single plane can be preferably perpendicular on the plane defined by the respective sidewall of the holder. According to certain embodiments, the plane can also be substantially parallel with a plane defined by the base of the holder.

It should be noted that the at least one pair of slots as defined above can extend through the coupling means, this optionally for, but possible for, all of the described embodiments.

In preferred embodiments the locations of the magnetized areas of the tray correspond to a predetermined pattern, the predetermined pattern corresponding to a predetermined filling of the tray with bread holders of predetermined sizes.

A predetermined filling can be such that an optimized, for instance, dense filling of the tray is achieved. The predetermined filling of the tray, and correspondingly the predetermined pattern, can be such that no magnetic influence exists on possibly tray integrated electronic devices as for instance display screens.

According to a second aspect of the present invention a tray is disclosed for use in a system according to the first aspect wherein the tray is magnetized in at least one magnetized area of the tray. Alternatively, one or more current conducting coils may be provided into the tray. The integration of the magnet into the tray is preferably such that the magnet is not exposed to food in use, preferably no grooves are created on the surface of the tray by integrating the magnets, for hygienic reasons.

In preferred embodiments the magnetization of the tray is caused my locally integrating magnets into the tray.

In preferred embodiments the tray consists at least in part of a material which is permanently magnetized.

According to certain embodiments it is thus not necessary to integrate separate magnets within (portions of) the tray, which can itself be magnetized locally.

According to a third aspect of the present invention a holder is disclosed for use in a system as described for the first aspect of the present invention.

According to a fourth aspect of the present invention holder manipulation means is disclosed for use in a system according to the first aspect of the present invention.

Further aspects of the present invention are described by the dependent claims. The features from the dependent claims, features of any of the independent claims and any features of other dependent claims may be combined as considered appropriate to the person of ordinary skill, and not only in the particular combinations as defined by the claims.

BRIEF DESCRIPTION OF THE DRAWINGS

The accompanying drawings are used to illustrate embodiments of the present invention.

FIG. 3A illustrates an example of a cut-out area in the holder according to embodiments of the present invention.

FIG. 3B is a perspective view of a holder according to embodiments of the present invention. FIG. 3C illustrates a holder manipulation means according to embodiments of the present invention, of the "magnetic type".

FIG. 3D illustrates another holder manipulation means according to embodiments of the present invention, and FIG. 3E illustrates the coupling with the holder of the holder manipulation means of FIG. 3D.

Reference signs are chosen such that they are the same for similar or equal elements or features in different figures or drawings.

DESCRIPTION OF ILLUSTRATIVE EMBODIMENTS

The above and other advantageous features and objects of the invention will become more apparent and the invention will be better understood from the following detailed description when read in conjunction with the respective drawings.

In the description of certain embodiments according to the present invention, various features are sometimes grouped together in a single embodiment, figure, or description thereof for the purpose of aiding in the understanding of one or more of the various inventive aspects. This is not to be interpreted as if all features of the group are necessarily present to solve a particular problem. Inventive aspects may lie in less than all features of such a group of features present in the description of a particular embodiment.

Figure 1:
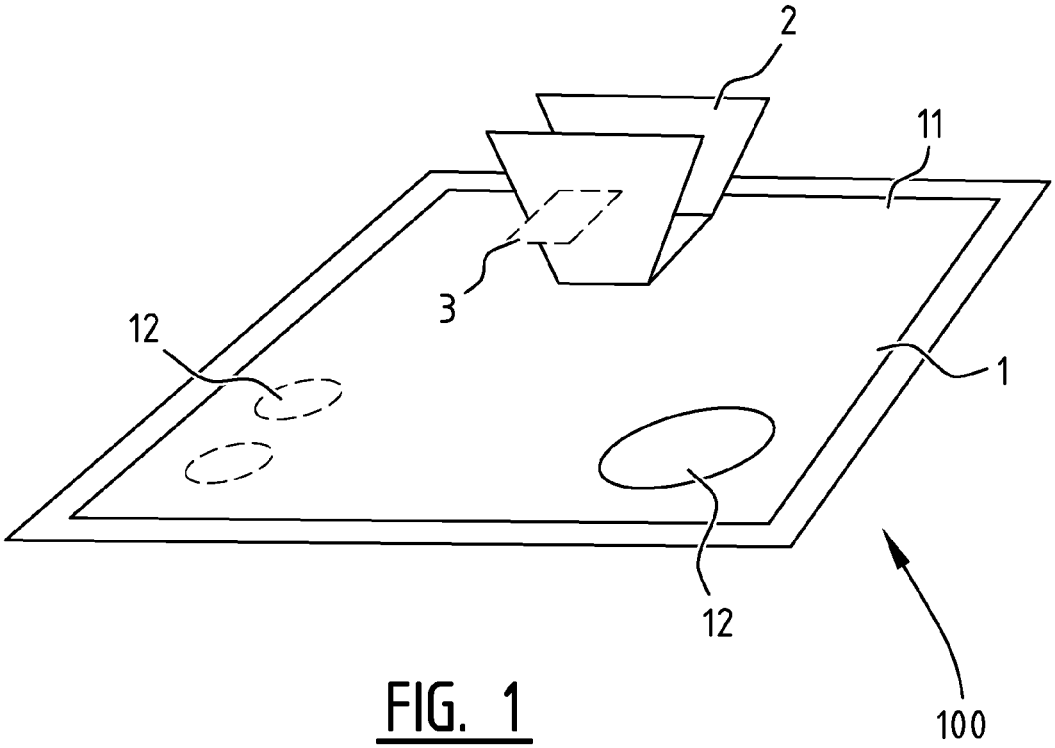
FIG. 1 illustrates a tray system according to embodiments of the present invention.

In FIG. 1 a tray system is schematically depicted corresponding to embodiments of the present invention. The system 100 comprises a tray 1 which comprises at least one magnetized area 12, for instance created by the integration of magnets within the tray, preferably below the tray surface. The tray may also comprise magnetized areas 12 without necessarily integrating independent magnets within the tray. On the main surface 11 of the tray a bread holder 2 can be positioned, preferably at locations corresponding to the magnetized areas 12 of the tray. The bread holder typically comprises a folded metal sheet substantially defining a U-shape, which is adapted for receiving a filled food article as for instance a small bread, for instance a pita bread. Typically, the small bread which can be received within the holder 2 is cut only halfway through and is filled with fine cut food and/or sauce. The holder is adapted for receiving the bread from its closed side. As the holder is magnetically attracted to the magnetized area of the tray, the falling over of the holder is avoided and the holder is thus stably positioned on the tray. The hungry consumer can receive or place the bread within the holder, which is keeping the bread upright. Thereby the loss or spilling of food on the tray or table can be avoided. When the consumer gets distracted while eating the pita bread, for instance by phone calls, the need for messaging, etc., he can place the pita bread in the holder without the inconvenience of losing the filling of the bread. The holder may further by coupled with a, preferably detachable, holder manipulation means 3 adapted for manipulating the holders, especially for placing and removing respective holders on respective trays.

Figure 2A:
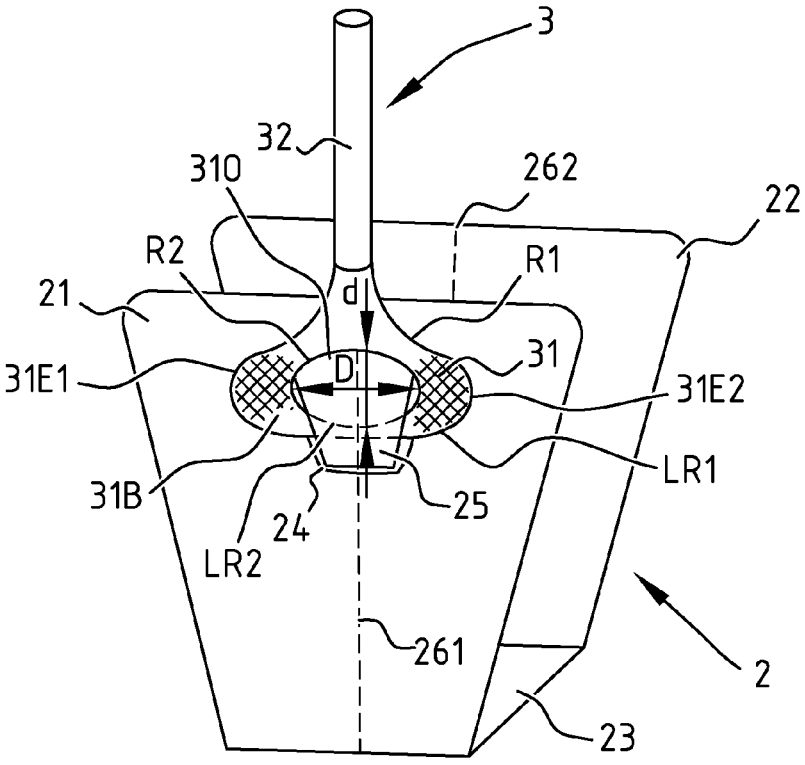
FIGS. 2A and 2B illustrate a holder and holder manipulation means according to embodiments of the present invention.

A first preferred embodiment is depicted in FIG. 2A. FIG. 2A depicts a substantially U-shaped holder comprising a base 23, a front side 21 and a back side 22. The front side 21 and back side 22 can be placed substantially perpendicular on the base 23, but may also be positioned under limited tilt angle with respect to the base, in order to create a slightly narrowing opening of the "U" when going from the entry of the U towards the base 23 of the holder 2. The side surfaces 21 and 22 may thus be arranged at an angle $\gamma$ with respect to a normal onto the base 23. The properties (choice of material, thickness of e.g. metal sheet, dimensions, etc.) of the holder are preferably determined such that they provide a gripping force on a food article which it holds, as for instance a pita bread. The side surfaces 21 and 22 may therefore be adapted for exerting a force on the food article, the force mainly directed toward the other side surface, when the food article is inserted in the holder. The holder may optionally comprise a pair of slots 261, 262 which are suited for guiding a knife for cutting a food article within the holder. The slots may extend from the upper rim of the holder towards the base 23 of the holder. The holder further comprises a coupling means 25 of the hook-type which can be for instance produced by providing a cut 24, for instance a substantially U- or V-shaped cut, in at least one sidewall of the holder and by bending the defined flap 25 forward hereby defining a coupling means of the hook-type. This coupling means can interact with a food manipulation means 3 which can for instance comprise a food manipulation coupling means 31 of the ring type for coupling with the coupling means, e.g. hook of the holder. The holder manipulation means typically further comprises a handle 32 which is connected with the coupling means 31. The defined flap 25, which may comprise two parts, e.g. two halves by being cut in two by a slot 261 or 262, may have a relatively large width at its upper part, and a relatively narrower width at its lower part. The width can for instance continuously decrease from the lower part towards the upper part. The decrease can for instance be linear. The holder coupling means 31 of the ring type may comprise or consist of an appropriately shaped piece of metal plate. It may be cut out of a metal plate with substantially constant thickness. This piece may comprise a bent portion between two substantially flat portions, thereby defining an angle $\alpha$ between the substantially flat portions. The two substantially flat portions may comprise a first portion to be integrated with the handle and a second portion comprising a structure of the ring type. The coupling means 31, more specifically the second portion, may comprise an opening 310 defining the inner rim of a ring structure R2. The ring structure is further defined by an outer rim R1. Near the handle, the outer rim R1 extends towards the handle. The inner rim R2 can define a substantially oval or substantially elliptic shape, for instance having a major axis D and a minor axis d. The length direction of the opening, e.g. the major axis D, can be oriented substantially orthogonal on the direction defined by the direction of the length of the handle. This configuration allows an effective and high quality coupling between the ring structure and the flap(s) 25. Especially in combination with flaps with decreasing width as described above, an efficient clamming is taking place between the flap(s) 25 and the ring structure. The opening preferably comprises a curved lower rim LR2 (e.g. a section of an ellipse). The contact between the curved lower rim LR2 with a substantially flat back surface of the flap 25 can be limited to mainly two contact points, which allows an efficient manipulation of the holders. The opening may also comprise a lower rim LR2 which can be substantially flat centrally, and which e.g. curves upwardly near the sides of the opening (thereby further defining the above mentioned shape).

The outer rim R1 may also define a large part of a substantially oval or substantially elliptic shape. The length direction of this shape may be oriented substantially orthogonal on the direction defined by the direction of the length of the handle.

According to preferred embodiments, the outer rim R1 has a substantially flat lower rim LR1. This may facilitate the coupling with the coupling means of the holder, as the flat lower rim may contact the flat outer surface of the holder and can be guided thereby. Furthermore, preferably, the inner and outer rim R2 and R1 also define extension areas 31E1 and 31E2 (shaded areas) on both sides of the opening 310. These areas (on the front surface 31F, opposite to the back surface 31B) are contacting the sidewall of the holder during use and can increase the stability of the coupling during use.

Figure 2B:
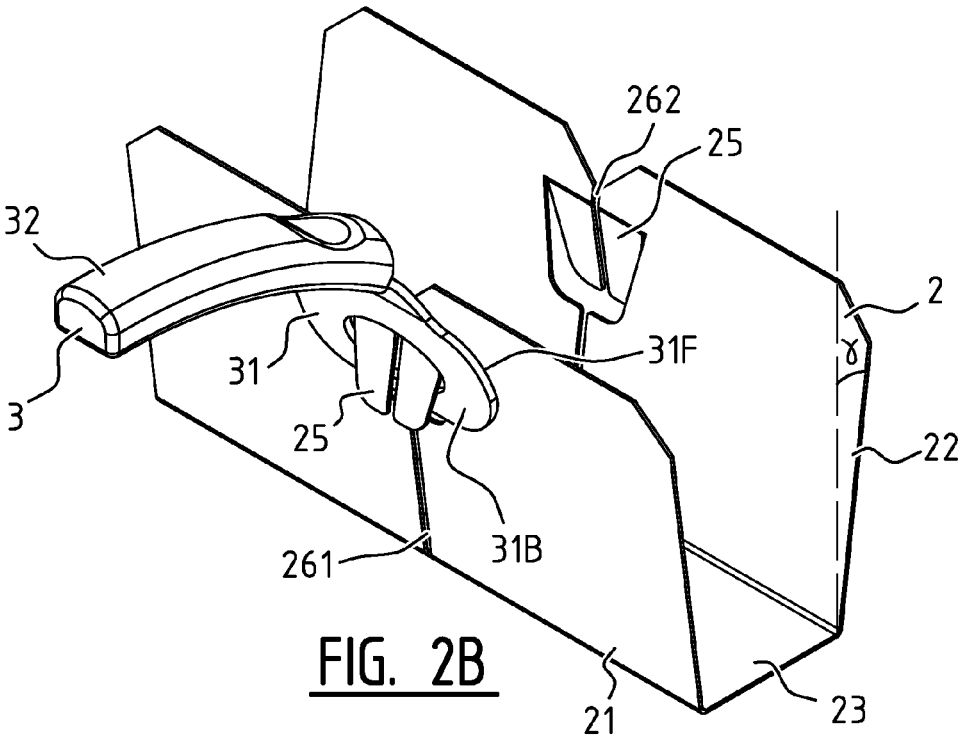

FIG. 2B illustrates a similar embodiment as depicted in FIG. 2A, wherein the slots 261 and 262 are provided, and wherein these slots are running through the coupling means 25. A slot can divide the coupling means vertically in two parts, e.g. two halves. The holder 2 in FIG. 2B has a width which is substantially larger than its height, and may therefore be better adapted for holding certain types of bread, as for instance longitudinally extending types as for instance sandwiches.

Figure 3A:
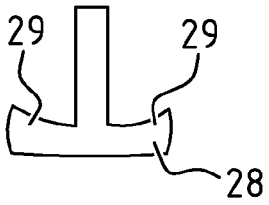
FIG. 3A to 3E illustrates alternative embodiments of a holder and holder manipulation means according to embodiments of the present invention.
Figure 3B:
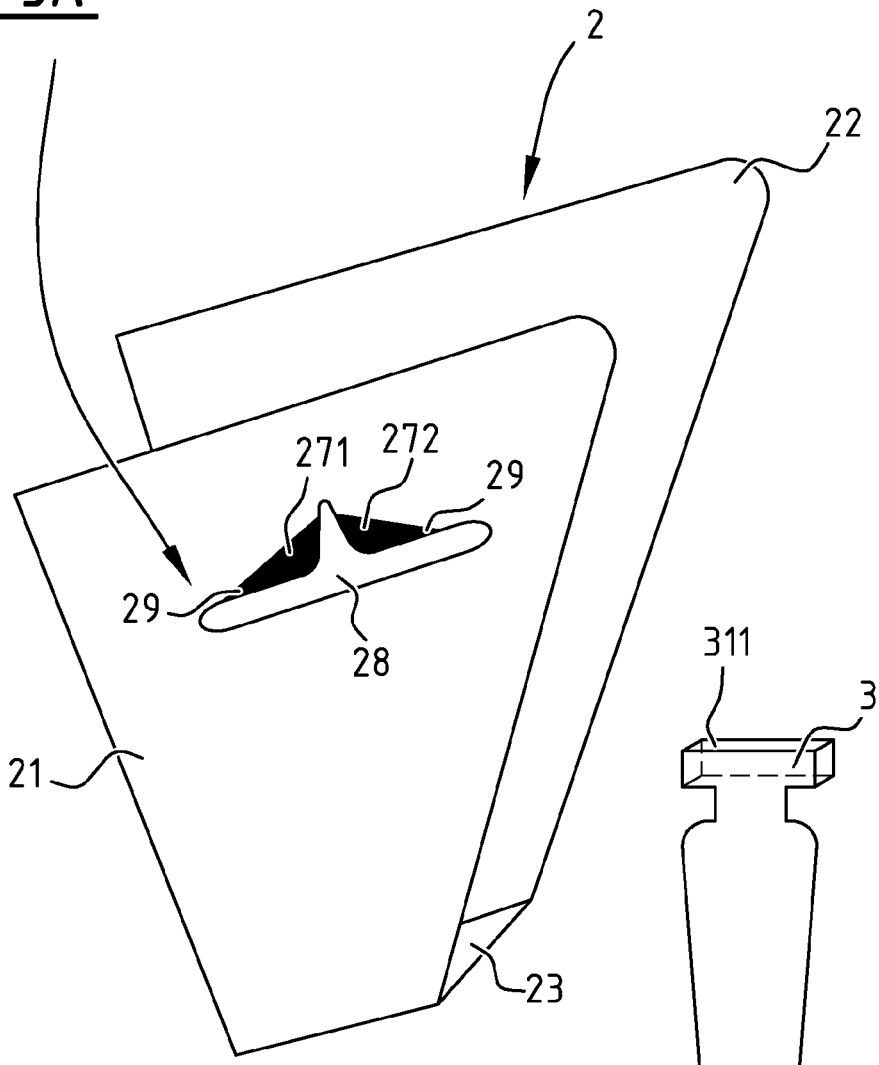

In FIG. 3B an alternative embodiment is depicted of a holder. The holder 2 is substantially U-shaped and similar to the holder 2 of FIG. 2A and 2B and comprises a front side 21 and a back side 22 which are connected by means of the base 23. The relative orientation of the front side, back side and base are similar to the embodiment described in FIGS. 2A and 2B. The holder in FIG. 3B differs from the one in FIGS. 2A and 2B in that a different coupling means is provided.

Figure 3C:
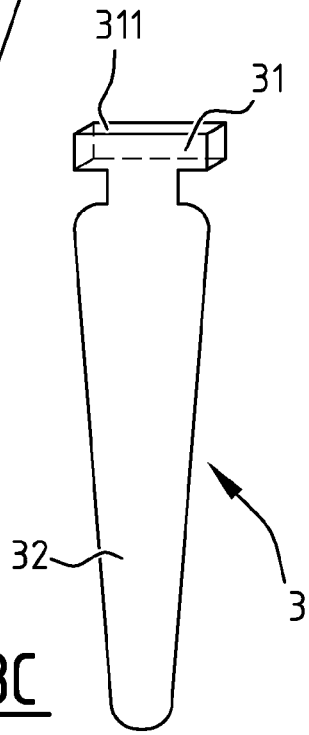

The coupling means comprises preferably a portion of the sidewall of the holder which comprises a material which can be attracted by a magnet. Typically, if the holder is produced out of a single metal sheet, the full sidewalls of the holder may satisfy this condition. The holder manipulation means 3 comprises a handle 32 which is connected with a coupling means 31. The coupling means 31 can comprise at least one magnet, or can comprise at least one portion which is magnetized. According to preferred embodiments different small magnets may be provided within the coupling means 31. The coupling means may also comprise a longitudinally extending magnet to be coupled with the holder in substantially horizontal position, below a similar non-magnetical element, which also substantially contacts the sidewall of the holder when the holder manipulation means and the holder are coupled. The non-magnetic part can for instance serve as or provide a torsion point/line between holder manipulation means and the sidewall of the holder, when disconnection the magnetic part of the coupling means 31 while removing the holder manipulation means from the holder. The holder 2 can then be coupled to the holder manipulation means by bringing the coupling means 31 into contact with the respective portion of the holder. According to preferred embodiments, the coupling means of the holder comprises a blocking means 27 (271, 272) in the form of an inverted T-shaped cut 28 above the respective portion. This inverted T-shaped cut 28 defines two flaps 271,272 which are bent outwardly and which define a blocking means 27 for blocking the possible sliding movement of the coupling means 31 of the holder manipulation means upwardly along the outer surface of the sidewall 21 of the holder. It will be recognized by the skilled person that other blocking means 27 can be thought of which provide the same functionality. According to preferred embodiments the coupling means 31 of the holder manipulation means 3 comprises a flat upper surface 311 and the rims 29 defined by the T-shaped cut are laying within a single plane in their outwardly bent state. In that case, the flat surface 311 (see FIG. 3C) of the coupling means 31 of the holder manipulation means can fully rest against the rims 29 defined by the T-shaped cut. It should be noted that the rims 29 of the T-shaped cut are in that case not straight lines, when cut in the metal sheet (see FIG. 3A), as they have to define a single plane only when they are bent outwardly (see FIG. 3A).

Figure 3D:
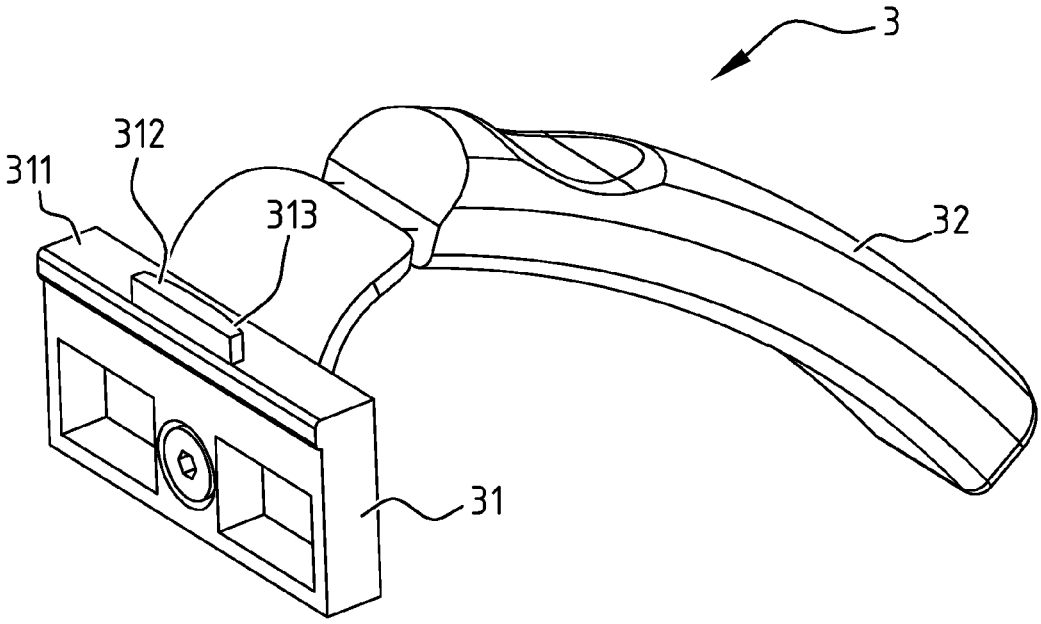
Figure 3E:
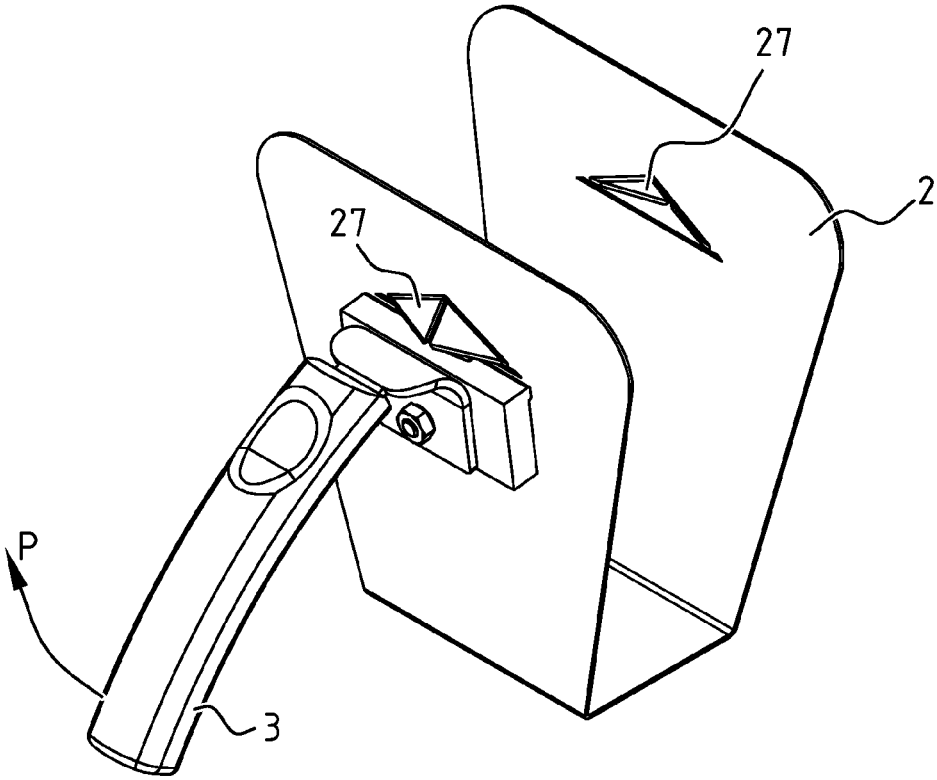

In FIG. 3D a further example of a holder manipulation means 3 is illustrated. It comprises a handle 32 connected to a coupling means 31. The coupling means comprises an upper surface 311. This upper surface can be substantially flat, ie lying in a single plane. It can then interact with the lower rim 29 of the flaps 271 and 272 as described above. Furthermore, the upper surface may comprise an upwardly extending protrusion 312 which is adapted for fitting behind the outwardly bent flaps (271,272) of said blocking means (27), when said holder manipulation means is coupled with said holder (see FIG. 3E). The protrusion 312 may further comprise a curved surface 313 which corresponds to the back surfaces (inner surfaces) of the outwardly bent flaps 271, 272 of the blocking means 27 when coupled with the holder coupling means. In other words the curved surface is advantageously adapted for fitting against, or resting against the back surfaces of the flaps. The protrusion 312 and optionally the curved surface 313, may strengthen and secure the coupling. It can be noted that typically no extra force is required for removing the protrusion from behind the flaps when removing the holder manipulation means from the holder. Only an appropriate movement with the handle may be required. Such a movement may comprise a substantially vertically, downward, movement. It may moreover comprise a rotational movement as indicated by arrow P, whereby the upper part of the coupling means 31 which rests against the sidewall of the holder may act as a pivot or torsion point.

The movement may comprise both types of these described movement components.

Figure 4:
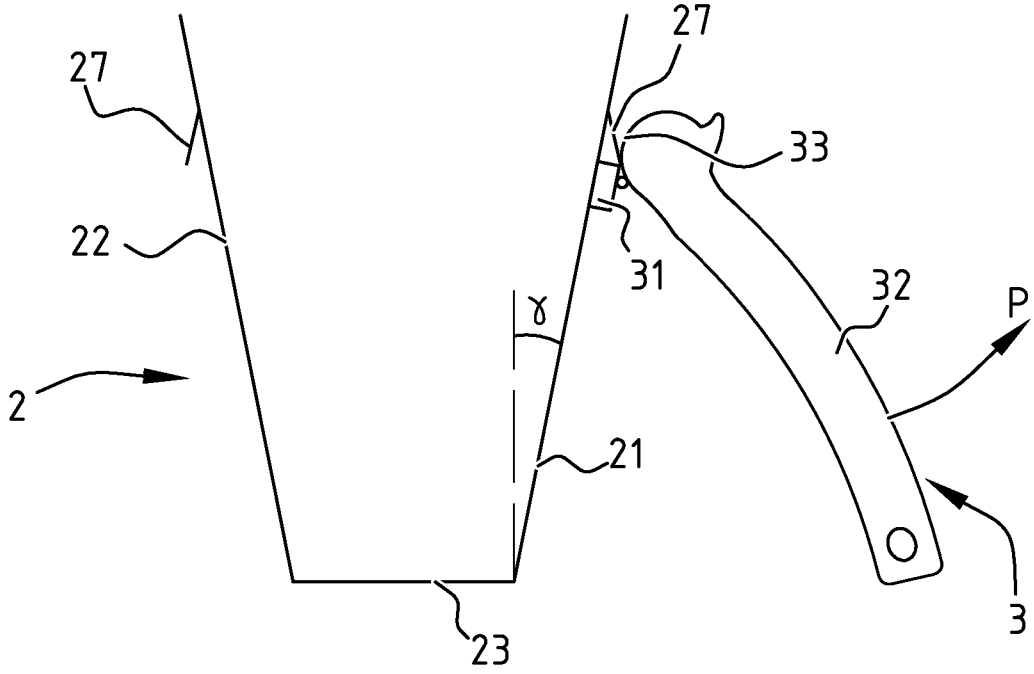
In FIG. 4 a schematic side view of the embodiments of the holder and holder manipulations means according to embodiments of the present invention as depicted in FIGS. 3A-3E is depicted.

In FIG. 4 an embodiment similar to the embodiment of FIGS. 3A to 3E is depicted, by means of a sectional side view. A holder 2 is depicted comprising a front side 21, a base 23 and a back side 22 and comprising flaps 27 as defined for FIGS. 3A to 3E. The holder manipulation means 3 comprises a handle 32 and a coupling means 31 to be coupled with the holder as described for FIG. 3A to 3E. The holder manipulation means is further adapted for being able to provide a leverage effect when decoupling the coupling means 31 from the coupling means of the holder. Therefore the holder manipulation means is preferably provided with a rounded portion 33 which is suited for being pressed against the outer surface of the holder, e.g. against the flags 27, when performing an upward pivoting movement (the arrow P) of the manipulation means, thereby pulling away the coupling means 31 from the coupling means of the holder. The leverage effect allows the removal of the coupling means 31 from the coupling means of the holder while reducing the risk that the holder and/or tray remains attached to the coupling means when pulling away the holder manipulation means. Alternative embodiments for providing this leverage effect can be thought of by the skilled person. FIG. 4 also illustrates the substantially V or U shaped cross section of the holder, comprising for instance an angle $\gamma$ between the base 23 and the side surfaces 21 and 22, according to preferred embodiments.

Figure 5:
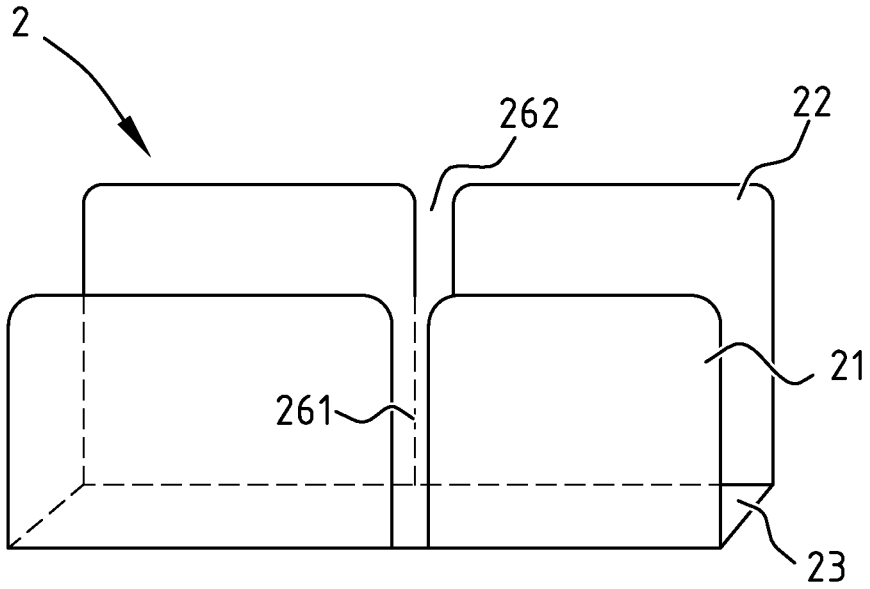
In FIG. 5 a further holder according to embodiments of the present invention is depicted.

In FIG. 5 an alternative holder 2 is depicted according to the present invention. The holder comprises a base 23, a front side 21 and a back side 22. The holder is substantially U-shaped in cross-section. The holder is moreover provided with a pair of slots 261, 262 which extend from the upper rim of the holder downwards, preferably up until the base 23. The slots are suitable for guiding a knife when cutting a bread which is held within the holder 2. Such a holder with holder 2 coupling means 25 is also provided in FIG. 2B.

Figure 6:
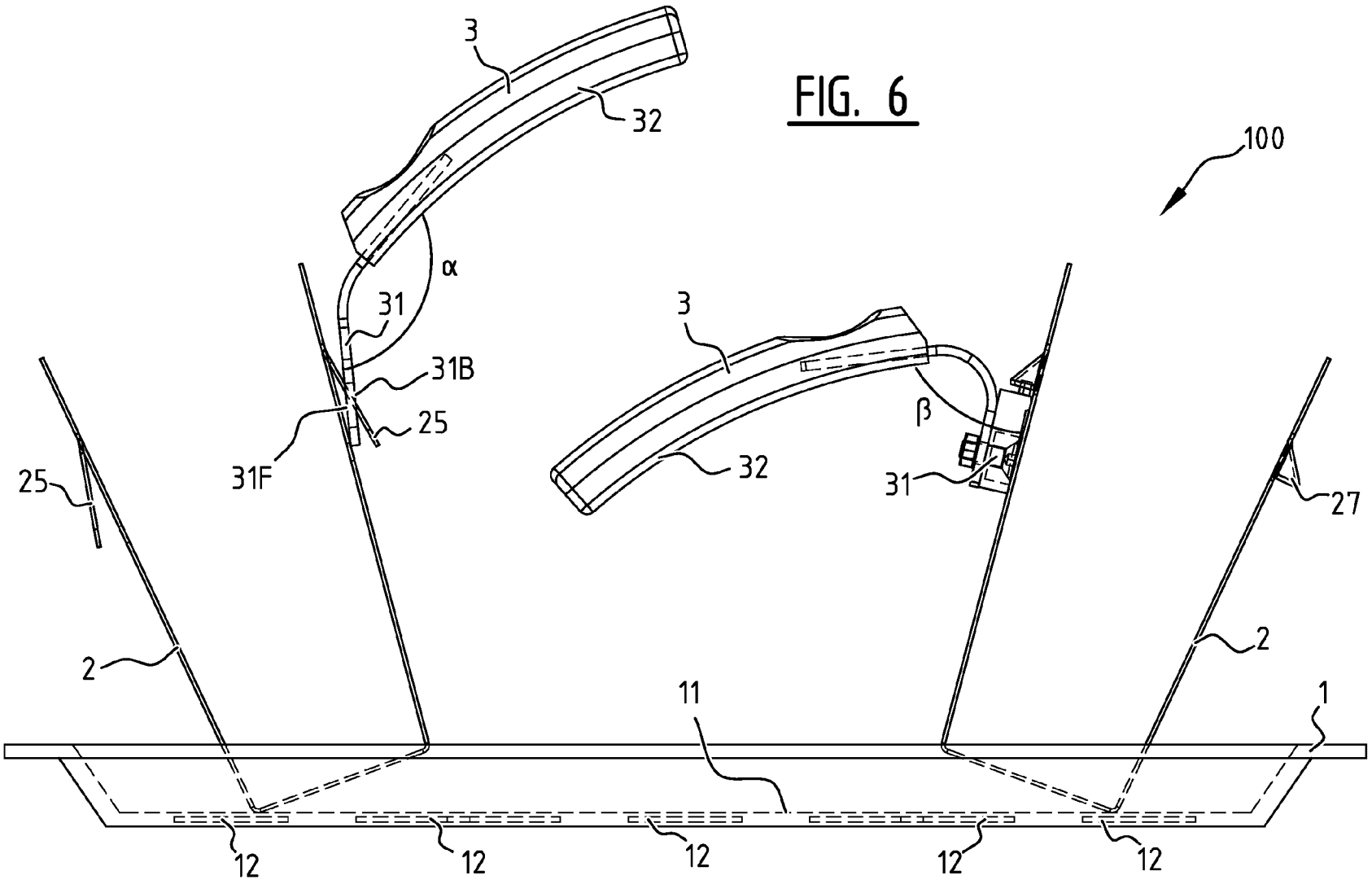
In FIG. 6 a tray system according to embodiments of the present invention is depicted. The use of both types of holders and corresponding holder manipulation means are illustrated.

In FIG. 6 different types of embodiments of holders and holder manipulation means are depicted. On the left, the holder comprises a hook 25 and couples with a ring 31. On the right a magnetic coupling means 31 and coupling means of the holder (comprising a blocking means 27 and part of the sidewall of the holder below the blocking means 27) are coupled. Both systems allow the removal of the holder or filled holder from magnetic areas 12 of the surface 11 of the tray 1. This may occur by first tilting the holder on one side in a first step, in order to gradually reduce the attraction force between holder and tray. The angle between the handle (or a representative direction (e.g. average direction) for the handle) and the front surfaces (to be brought at least partially in contact with the side surface of the holder) of the coupling means ($\alpha$, $\beta$) can be predetermined in order to optimize the efficiency of coupling between the respective holder and holder manipulation means during use.

Although the holder manipulation means which magnetically couples with a holder typically comprises a magnet, and typically cooperates with a part of the holder that is attracted by this magnet, the opposite situation wherein the holder comprises a magnet or magnetized area which can couple with the coupling means 31 which is attracted to said magnet or magnetic area is not excluded. Also both the holder and the manipulation means may comprise respective magnetic areas or magnets, in order to further increase the coupling strength, according to further embodiments.

Moreover, according to embodiments of the present invention, the holder may comprise a different type of holder coupling means on different side surfaces. On one side a holder coupling means may be present of the hook type, while on the other side a holder coupling means of the magnetic type can be provided. Such embodiments may be particularly useful in case where different users prefer or require different manipulation means, for instance because of personal preferences but for instance also in function of the type of bread to be held/manipulated, and/or in function of where the user is positioned with respect to the holder during use. A first user may for instance be located behind a bar, table or counter typically located at a higher level than the rest of the room, and may require a coupling/manipulation means of the hook/ring type in order to put the holder on the counter. A second user may for instance be a waiter who brings the holder to the customer in the room, and may have to reach upwardly in order to get to the holder on the counter. This user may prefer the use of a magnetic coupling means/magnetic manipulation means.

It can be noted that embodiments according to the present invention provide a variety of advantages compared to state of the art tray systems and methods for serving food.

The system according to aspects of the present invention provides more comfort to the user, as well as to the waiter, when handling the food articles. It may further result in the reduction of waste. Furthermore, a quicker and more efficient serving of clients within for instance a snack bar can be obtained. The holder according to embodiments of the present invention can be produced lightweight and at low production costs, while it is stable, i.e. it allows the food article to be held in an upright position without falling over, due to the coupling with the at least partially magnetized tray. It can also be noted that the coupling between the holder and the tray may in practice also result in a reduction of the number of holders which may be stolen by customers as the holders themselves typically do not provide the necessary stability for being used to keep food articles upright in a stable manner.

Furthermore, it will be recognized, that trays of different sizes may be combined within a single system. For instance a "mother tray", may be provided, which is adapted for being used to transport food articles from a first location to a second location, the first location for instance being a kitchen corresponding to a production place of the food article and the second place corresponding to a table positioned in a room where the customer will consume the food articles. Such a mother tray can typically be relatively large, and is preferably adapted to be able to receive a large number of food articles in their respective holders, such that the waiter can easily carry a large number of holders.

Another type of tray ("consumer tray") may be of smaller size when compared to the mother tray or may comprise a different distribution of magnetized areas within the tray. These consumer trays may comprise a limited amount of magnetized areas as they may further comprise display screens or other features which may not be compatible with the presence of magnetized areas within the tray.

It can further be noted that the holders as described according to embodiments of the present invention may, instead of being magnetically coupled with magnetic areas of respective trays, also be provided to the customers by being coupled with other docking means. For instance, the holders comprising coupling means of the hook-type, may be attached to an associated wall docking means. This associated wall docking means may for instance comprise a thin, for instance metal, longitudinal strip or plate which can be placed substantially horizontally and which can preferably be fixed with respect to the wall. For instance a gap can be provided between the horizontally placed longitudinal strip and the wall, which is adapted for receiving the hook portion of the coupling means of the holder. This way the holder containing the food article can be temporarily attached to the wall while the consumer is distracted from consuming. At least one of these docking means can also be comprised within a system described before, according to embodiments of the present invention.

According to further embodiments of the present invention, also another type of docking means, a counter docking means, may be provided to the system. This counter docking means may for instance comprise at least one magnetized portion, and can be adapted to be permanently fixed to the upper surface of a counter or similar device (e.g. a table). The possibly filled holder as described according to embodiments of the present invention can then be stably positioned on the upper surface of the counter or table, whereby the holder is magnetically attracted to the respective magnetized portion.

While some embodiments described herein include some but not other features included in other embodiments, combinations of features of different embodiments are meant to be within the scope of the invention, and form different embodiments, as would be understood by the skilled person.

While the principles of the invention have been set out above in connection with specific embodiments, it is to be clearly understood that this description is merely made by way of example and not as a limitation of the scope of protection which is determined by the appended claims.

The invention claimed is:

1. A tray system, comprising:

a tray for carrying food articles which is magnetized in at least one magnetized area of said tray; and at least one holder adapted for holding a filled food article, said holder comprising a holder coupler and a holder manipulator, wherein said holder manipulator is adapted for being coupled with said holder coupler, the strength of said coupling being strong enough such that said holder can be carried by said holder manipulator and such that it allows for removing said holder from said at least one magnetized area of said tray using said holder manipulator; and wherein said tray and said at least one holder being adapted such that when said holder is placed on said at least one magnetized area of said tray said holder is attracted to said tray, the magnetic attraction force between said holder and said tray being large enough in order to stably position said holder on said tray to prevent said holder from falling over when said holder holds a filled food article.

2. A tray system according to claim 1, wherein said holder coupler is of the hook-type, the opening of said hook being directed downwards during use, and wherein said holder manipuplator is adapted for coupling with said hook by cooperating with said opening.

3. A tray system according to claim 2, wherein said holder coupler comprises at least one outwardly bent flap of the sidewall of the holder, said flap being formed by a cut in said sidewall.

4. A tray system according to claim 2, wherein said holder manipuplator comprises a coupling structure of the ring type for coupling with said holder coupler of the hook-type.

5. A tray system according to claim 1, wherein said holder coupler comprises a part of the sidewall of said holder, said part comprising a material which can couple magnetically with a magnet, and wherein said holder manipulator comprises a coupler comprising at least one magnet for coupling with said part.

6. A tray system according to claim 5, wherein said holder coupler further comprises a blocker for preventing said holder manipulator from sliding upwardly on said sidewall of said holder when coupled.

7. A tray system according to claim 6, wherein said blocker is formed by an inverted-T-shaped cut, wherein flaps defined by said cut being bent outwardly.

8. A tray system according to claim 7, wherein said holder manipulator is adapted for being able to provide a leverage effect when decoupling said at least one magnet from said holder.

9. A tray system according to claim 7, wherein said coupler of said holder manipulator comprises an upwardly extending protrusion which is adapted for fitting behind the outwardly bent flaps of said blocker, when said holder manipulator is coupled with said holder.

10. A tray system according to claim 1, wherein the locations of said magnetized areas of said tray correspond to a predetermined pattern.

11. A tray system according to claim 1, wherein said holder is provided with at least one pair of slots which are adapted for receiving and guiding a knife such that said knife can cut a bread held in said holder.

12. A tray system according to claim 11, wherein at least one slot runs through and at least one holder coupler.

13. A tray system according to any of the previous claims, wherein said holder comprises a substantially U-shaped folded sheet of metal.

14. A tray system according to claim 1, wherein said tray is magnetized by a local magnet integrated into said tray.

15. A tray system according to claim 14, wherein said magnet is permanently magnetized.

16. A tray system according to claim 1, wherein said holder coupler is positioned above two-thirds of the height of said holder.

17. A tray system according to claim 1, wherein said holder manipulator is detachably coupled to said holder coupler.

18. A tray system according to claim 1, wherein said holder comprises two holder couplers.

* * * * *